United States Patent [19]

Bayer et al.

[11] 4,038,856

[45] Aug. 2, 1977

[54] DRIVEN ROLLER ASSEMBLY FOR SUPPORTING, CONVEYING, BENDING, STRAIGHTENING OR DEFORMING A CONTINUOUSLY CAST STRAND

[75] Inventors: Franz Bayer; Werner Scheurecker, both of Linz, Austria

[73] Assignee: Vereinigte Osterreichische Eisen- und Stahlwerke-Alpine Montan Aktiengesellschaft, Linz, Austria

[21] Appl. No.: 729,404

[22] Filed: Oct. 4, 1976

[30] Foreign Application Priority Data

Oct. 8, 1975 Austria ..... 7686/75

[51] Int. Cl.[2] ..... B21B 31/08

[52] U.S. Cl. ..... 72/238; 164/282

[58] Field of Search ..... 164/282; 72/238, 239; 100/168

[56] References Cited

U.S. PATENT DOCUMENTS

| | | | |
|---|---|---|---|
| 3,566,653 | 3/1971 | Unrath | 72/238 X |
| 3,651,679 | 3/1972 | Shumaker | 72/238 |

*Primary Examiner*—Milton S. Mehr

*Attorney, Agent, or Firm*—Brumbaugh, Graves, Donohue & Raymond

[57] ABSTRACT

A driven roller assembly to be used for a continuously cast strand has a drive unit detachably connected to one end of the roller, and a holding means journaled on a strand guide stand and movable perpendicularly to the roller axis supports the drive unit, the roller being removable from the strand guide stand independently of the drive unit.

11 Claims, 7 Drawing Figures

Figure 1:
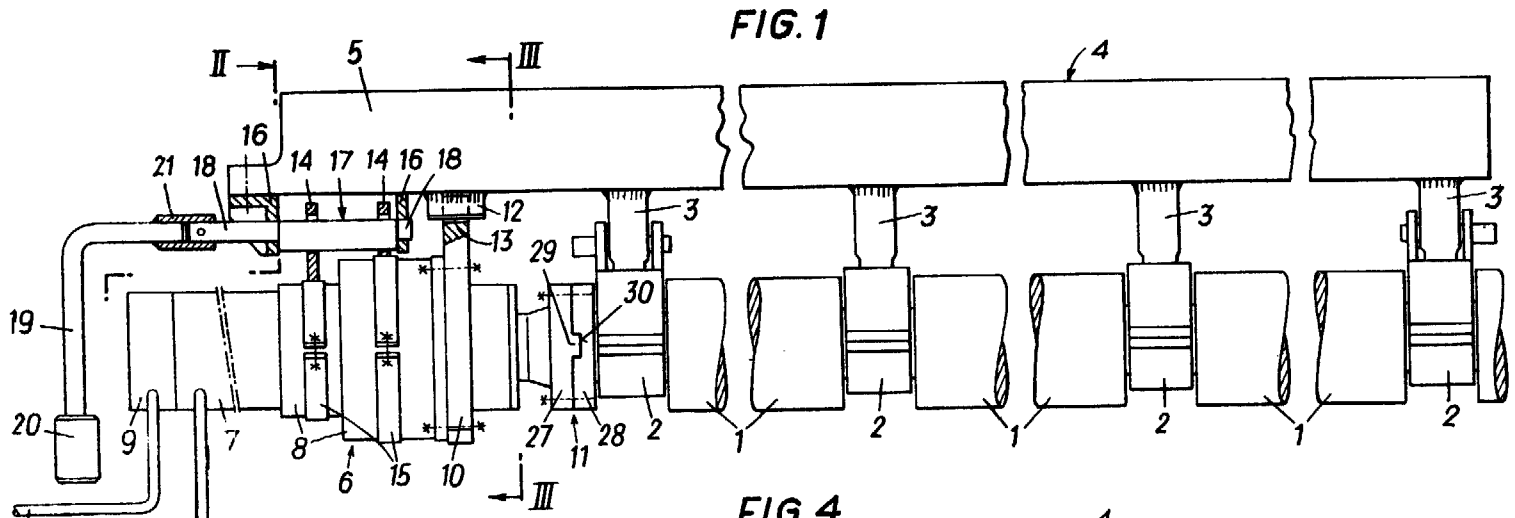

1
2
3
4
5
6
7
8
9
10
11
12
13
14
15
16
17
18
19
20
21
27
28
29
30
33
II
III 1
2
3
4
5
6
7
8
9
10
11
12
13
14
15
16
17
18
19
22
23
24
27
28
29
30
33
V

DRIVEN ROLLER ASSEMBLY FOR SUPPORTING, CONVEYING, BENDING, STRAIGHTENING OR DEFORMING A CONTINUOUSLY CAST STRAND

The invention relates to a driven roller or roll for supporting, conveying or bending, straightening or deforming a continuously cast strand, which roller is rotatably journaled in a strand guiding stand and has a drive unit detachably connected to one end of the roller or roll.

Driven rollers are arranged between non-driven rollers along the strand guiding path and cause a uniform application of the extraction force onto the strand and thus a careful treatment of the strand having a still liquid core. Furthermore, driven rollers can serve for conveying the cold strand or starter bar, respectively.

Since the rollers or rolls are arranged very closely behind one another, it is necessary to accommodate the drive of the driven rollers as space-savingly as possible, for instance by flyingly slipping it onto a roller end.

It has shown that rollers are subject to an extremely high wear and thus have to be exchanged quite frequently. A construction enabling a quick roller exchange thus is of great importance. Hitherto it has been complicated and time-consuming to exchange driven rollers, since it was necesssary also to remove and install the drive unit connected to a roller end as well as to detach and re-mount all the supply conduits of the drive unit.

The invention aims at preventing these disadvantages and difficulties and has as its object to provide a driven roller of the above defined kind in a manner so as to enable an exchange that is as quick as possible and as independent of the drive unit as possible, wherein the facility downtime caused by the exchange of the roller can be kept as short as possible.

According to the invention this object is achieved in that the drive unit is supportable by a holding means such as a bolt, journaled on the strand guide stand and movable perpendicular to the roller axis, wherein the roller is removable from the stand independently of the drive unit remaining on the stand.

Advantageously, the bolt is eccentrically rotatably mounted on the strand guide stand. A turning of the bolt causes an axis displacement of the same, whereby the drive unit rests on the bolt with its weight and does no longer load the roller.

Advantageously, the drive unit is provided with carrying brackets penetrated by the bolt.

Advantageously, the bolt is arranged either parallel relative to the direction of the roller axis and the drive unit is displaceable along the bolt, or parallel relative to the conveying direction of the strand and the drive unit is pivotable around the bolt.

For handling the drive unit it is advantageous that the eccentrically journaled bolt is arranged with its axis of rotation in a plane extending through the center of gravity of the drive unit at a right angle to the roller axis or to the conveying direction of the strand.

For an easy handling of the bolt, the bolt is extended at one end and provided with a detachable actuating lever.

The actuating lever is provided with a weight at its end so that the bolt is turned into the correct position during the casting operation and also remains in that position.

According to a preferred embodiment of the invention the drive unit is connectable with the roller by means of a flange coupling, whose coupling discs are provided with engaging claws and holes and connectable by hammer screws insertable into slots arranged in radial direction. This has the advantage that the drive unit need only be slightly displaced or pivoted in the direction of the roller axis when mounting or demounting the roller.

Figure 4:
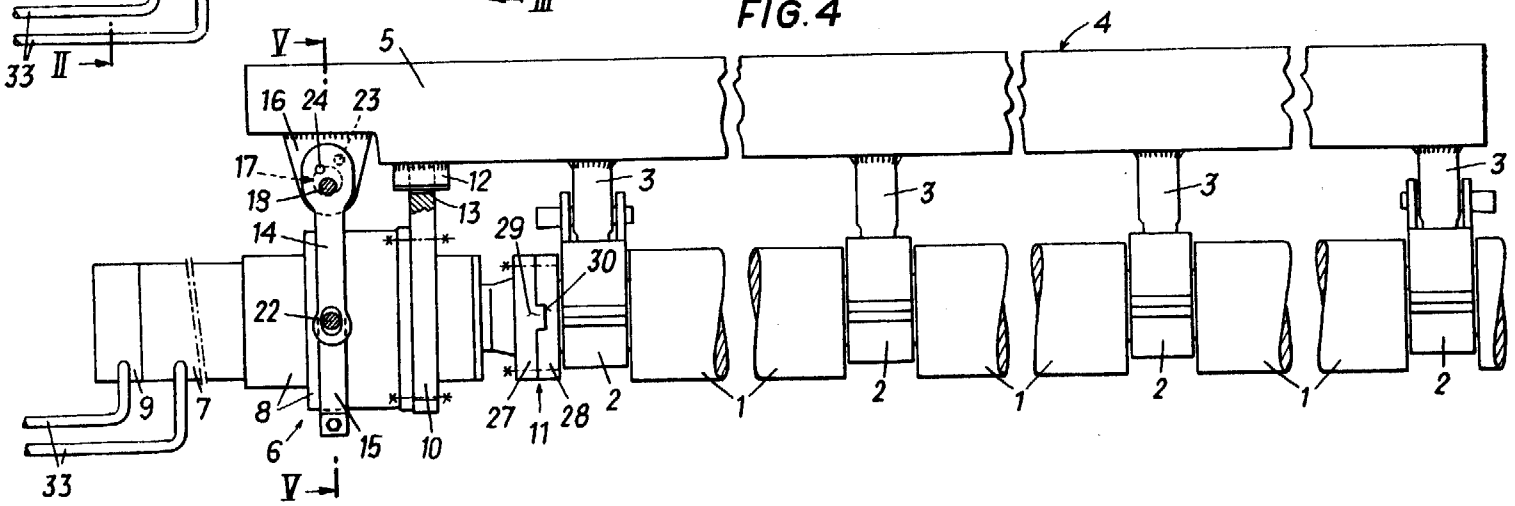
Figure 2:
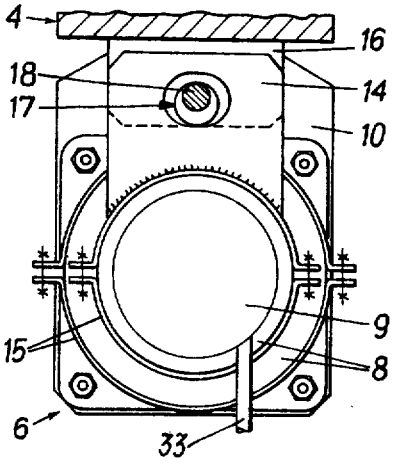
Figure 3:
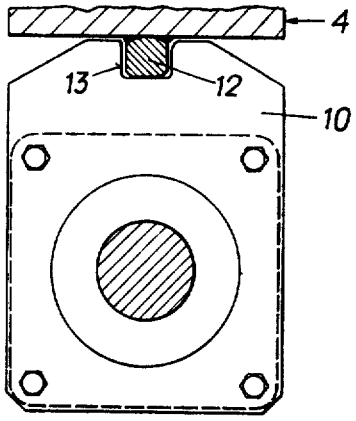
Figure 5:
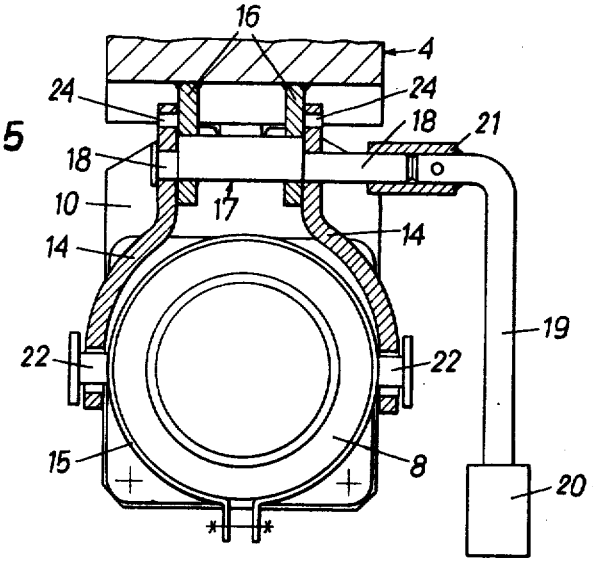
Figure 6:
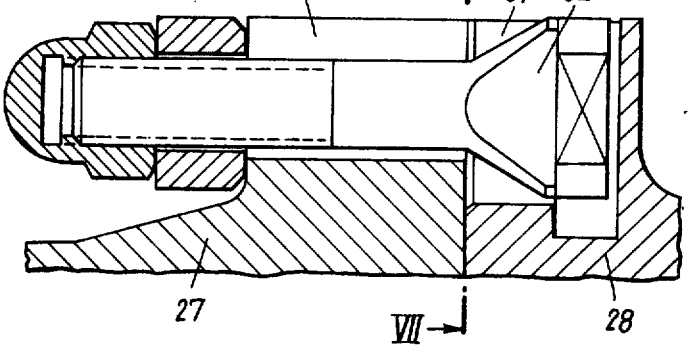
Figure 7:
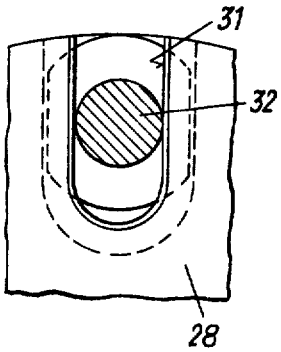

The invention shall now be described by way of example only and with reference to the accompanying drawings, wherein:

FIG. 1 is a view of a driven roller in conveying direction of the strand,

FIGS. 2 and 3, respectively, are views of a section along line II — II and III — III, respectively, of FIG. 1, FIGS. 4 and 5 show in illustrations similar to those of FIGS. 1 and 2 a driven roller according to another embodiment of the invention, and FIGS. 6 and 7 show a detail of the detachable coupling between the drive unit and the roller on an enlarged scale, FIG. 6 being a section through the axis of the roller, and FIG. 7 being a section along line VII — VII of FIG. 6.

With 1 the driven roller is denoted, which is rotatably journaled in a number of bearings 2 distributed over its longitudinal extension, which bearings are supported via bearing supports 3 on a carrier 4 backing up the roller. The carrier 4 which is part of the stationary strand guide stand not further illustrated, at one end is extended beyond the roller. At this end 5 of the carrier 4 the drive unit 6, comprising an oil pressure motor 7, a gear 8, a brake 9 and a torque support 10, is flyingly arranged on the roller by means of a detachable flange coupling 11. It is only supported via the torque support 10 that is displaceable, with a recess 13 along a block 12 secured to the carrier 4, in axis direction of the roller. The drive unit 6 is provided with carrying brackets 14 secured to it by means of clips 15. The carrying brackets 14 are connected with brackets 16, rigidly mounted on the carrier 4, by a bolt 17 having axle journals 18 arranged eccentrical to its axis and being rotatable therearound. One of the axle journals 18 of the bolt is extended at one side and provided with an actuating lever 19 via a detachable thimble coupling 21, a weight 20 being arranged at the end of the actuating lever 19.

According to the embodiment shown in FIGS. 1 to 3, the bolt 17 arranged parallel to the direction of the roller axis penetrates the carrying brackets 14 with play and the brackets 16 with its axle journals 18 without play. The drive unit 6 is displaceable with the carrying brackets 14 along the bolt 17. In operation, i.e. when the roller is connected with the drive unit, the weight 20 maintains the bolt 17 in a position in which it penetrates the carrying brackets without contact, whereby the flying attachment of the drive unit on the roller is also safeguarded when thermal expansions or saggings of the roller occur.

When the roller is to be removed, the bolt 17 is rotated by means of the actuating lever until it accommodates the weight of the drive unit via its carrying brackets. Subsequently the coupling 11 can be detached and the drive unit displaced along the bolt 17. Thereby the coupling halves of the coupling 11 move apart and the roller can be removed from the bearing supports 3. The drive unit stays on the carrier 4 of the strand guide stand and need no longer be removed when a roller is exchanged. Thus one does not only spare the lifting out of the drive unit, but also the detaching of its supply conduits 33. The supply conduits permit the movements of the drive unit necessary for a roller removal by elastic deformation. When a roller is installed this is done in opposite sequence, wherein the drive unit can be brought into precise alignment with the roller by rotating the bolt 17.

According to the embodiment shown in FIGS. 4 and 5, the carrying brackets 14 are secured by the carrying pins 22 to the clip 15 surrounding the drive unit, the carrying pins 22 penetrating the carrying brackets 14 and play in order to safeguard the flying attachment of the drive on the roller also when the roller sags. The bolt 17 eccentrically journaled on the carrier 4 in this case is arranged parallel to the conveying direction of the strand and in a plane extending through the center of gravity of the drive unit. The drive unit thus is pivotable around the bolt and liftable and lowerable by turning the bolt. When in operation, the weight 20 holds the bolt in a position in which the carrying pins 22 do not transmit any weight forces via the carrying brackets 14 onto the strand guide stand. When the roller is removed, the carrying bracket 14 is lifted by turning the bolt 17 until the drive unit rests with its load via the carrying brackets 14 and 16 on the carrier 4. Then the coupling 11 can be detached and the drive unit pivoted around the bolt 17, so that the roller can be removed from the bearing supports 3.

When pivoting the drive unit around the bolt 17, bores 23 provided in the brackets 16 are brought into alignment with bores 24 provided in the carrying brackets 14, whereby a positioning pin not illustrated in detail can be inserted to penetrate both bores 23 and 24, so that the drive unit remains in the pivoted position. The mounting of a roller takes place in the opposite sequence. An alignment of the drive unit to the installed roller is enabled in this embodiment also by rotating the bolt 17.

In order that the drive unit has to be moved only as little as possible in the direction of the roller axis during a roller exchange, the coupling 11 is designed as flange coupling whose coupling discs 27 and 28 are provided with engaging claws 29 and holes 30 and are connectable by hammer screws 32 insertable into slots 31 arranged in radial direction.

We claim:

1. In a driven roller assembly for supporting, conveying bending, straightening or deforming a continuously cast strand, with a roller rotatably journaled on a strand guide stand, and having a drive unit detachably connected to one end of the roller, the improvement comprising a holding means for supporting the drive unit, which holding means is journaled on the strand guide stand and movable perpendicularly relative to the roller axis, the roller being removable from the strand guide stand independently of the drive unit remaining on the strand guide stand.

2. A driven roller assembly as set forth in claim 1, wherein the holding means is a bolt.

3. A driven roller assembly as set forth in claim 2, wherein the bolt is eccentrically rotatably journaled on the strand guide stand.

4. A driven roller assembly as set forth in claim 2, wherein the drive unit comprises carrying brackets to be penetrated by the bolt.

5. A driven roller assembly as set forth in claim 2, wherein the bolt is arranged to be parallel relative to the roller axis and the drive unit is displaceable along the bolt.

6. A driven roller assembly as set forth in claim 2, wherein the bolt is arranged to be parallel relative to the conveying direction of the strand and wherein the drive unit is pivotable around the bolt.

7. A driven roller assembly as set forth in claim 3, wherein the eccentrically rotatably journaled bolt is arranged with its axis of rotation in a plane extending through the center of gravity of the drive unit at a right angle relative to the roller axis.

8. A driven roller assembly as set forth in claim 3, wherein the eccentrically rotatably journaled bolt is arranged with its axis of rotation in a plane extending through the center of gravity of the drive unit at a right angle relative to the conveying direction of the strand.

9. A driven roller assembly as set forth in claim 3, wherein the bolt is extended at one end, a detachable actuating lever being provided at said end.

10. A driven roller assembly as set forth in claim 9, further comprising a weight arranged to load the actuating lever at its end.

11. A driven roller assembly as set forth in claim 1, further comprising a flange coupling for connecting the drive unit with the roller, the flange coupling having coupling discs provided with engaging claws and holes and with radially arranged slots, into which slots hammer screws are insertable for connecting the coupling discs.

* * * * *